United States Patent [19]

Priebe

[11] Patent Number: 4,747,235

[45] Date of Patent: May 31, 1988

[54] DEVICE FOR SHARPENING BROADHEADS

[76] Inventor: Raymond G. Priebe, P.O. Box 691, Grayling, Mich. 49738

[21] Appl. No.: 22,877

[22] Filed: Mar. 6, 1987

[51] Int. Cl.[4] ..... B24D 15/02

[52] U.S. Cl. ..... 51/211 R; 51/214

[58] Field of Search ..... 51/156, 157, 158, 204, 51/205 R, 205 WG, 211 R, 211 H, 214, 330, 391, 392; 76/82, 86, 88

[56] References Cited

U.S. PATENT DOCUMENTS

| | | | |
|---|---|---|---|
| 1,906,881 | 5/1933 | Olas | 51/205 R |
| 1,909,743 | 5/1933 | Blankner | 51/214 |
| 2,647,351 | 8/1953 | Arnold | 51/330 |
| 2,798,344 | 7/1957 | Hertel | 51/211 R |
| 3,797,334 | 3/1974 | Sinclair | 51/214 X |
| 4,078,455 | 3/1978 | Brody | 51/214 X |
| 4,272,925 | 6/1981 | Graves | 51/211 R |
| 4,599,919 | 7/1986 | Fortenberry | 76/86 |
| 4,696,129 | 9/1987 | Roberts | 51/214 |

OTHER PUBLICATIONS

Advertising Copy—TruAngle Broadhead Hones, Inc-.—Copyright May, 1984.

*Primary Examiner*—Robert P. Olszewski

*Attorney, Agent, or Firm*—Gifford, Groh, VanOphem, Sheridan, Sprinkle and Dolgorukov

[57] ABSTRACT

A device for sharpening arrow broadheads having a base, a first hone and a second hone. Both hones are pivotally mounted to the base about axes which are spaced apart and parallel to each other so that the inclination of the hones can be varied with respect to each other in order to accommodate different types and styles of broadheads. The lateral spacing between the pivotal axes of the hones is also user adjustable.

5 Claims, 1 Drawing Sheet

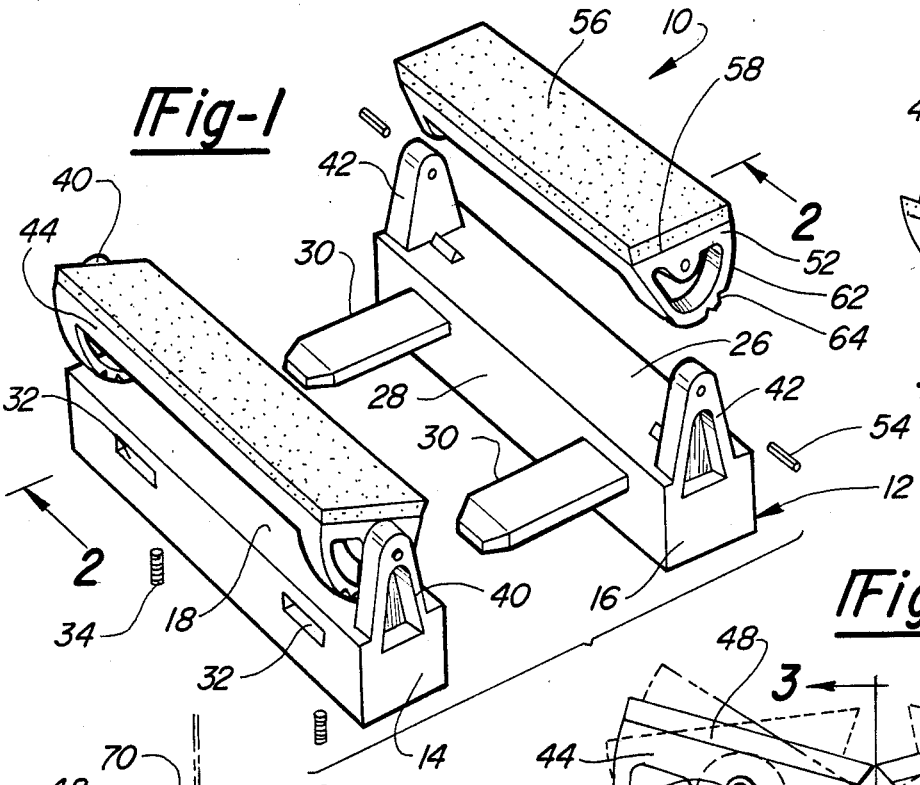
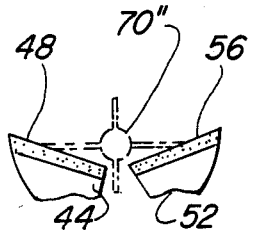
Fig-4C
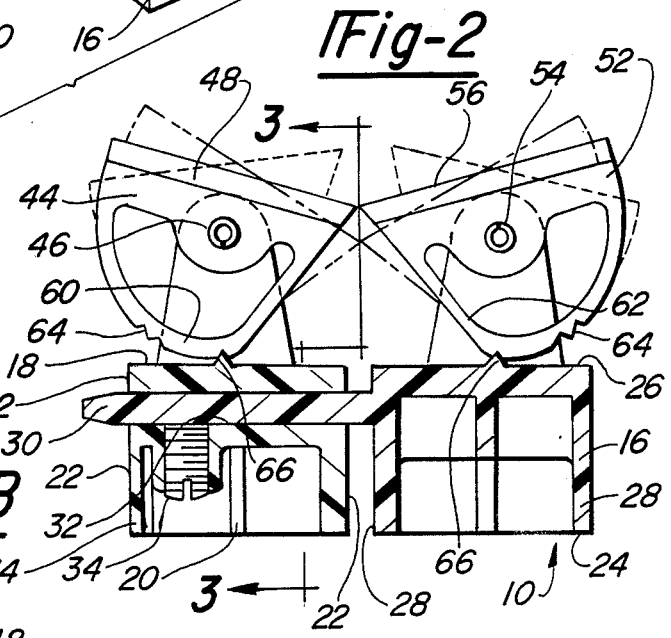
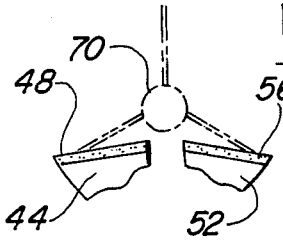
Fig-4A
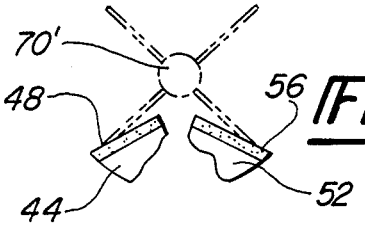
Fig-4B
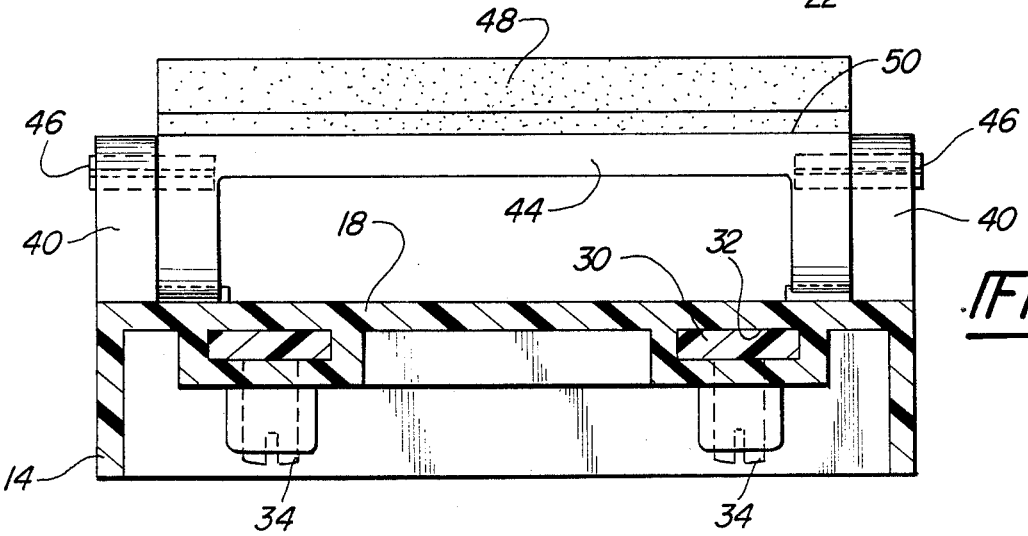
Fig-3

DEVICE FOR SHARPENING BROADHEADS

BACKGROUND OF THE INVENTION

I. Field of the Invention

The present invention relates generally to sharpeners and, more particularly, to a sharpener for sharpening arrow broadheads.

II. Description of the Prior Art

There are a number of different types and configurations of arrow broadheads. These different types of broadheads are used not only for different types of game but also depend, in large part, upon the personal preferences of the archer.

In order for effective hunting, the broadheads must be sharpened prior to use. Furthermore, the actual angle of the broadhead cutting edges with respect to the other broadhead edges varies between the various types or styles of broadheads. For effective hunting, the broadheads must be sharpened at a particular angle for the broadhead design in order for the most effective hunting for the archer.

There have been previously known sharpeners that are specifically designed to sharpen arrow broadheads. These previously known sharpeners typically comprise two planar hones which are mounted to a base. Futhermore, the hones lie in planes which are angled with respect to each other at a preset amount in order to accommodate a particular broadhead design. The broadheads are then stroked across the hones in the conventional fashion in order to sharpen them.

One disadvantage of these previously known sharpeners is that a separate sharpener must be purchased for each different style of broadhead. Thus, in order to accommodate the more popular styles of broadheads, three or even more separate sharpeners must be purchased in which the hones on each sharpener intersect each other at a different angle of inclination. This not only increases the expense of purchasing a set of sharpeners for broadheads, but also increases their bulk and their weight.

SUMMARY OF THE PRESENT INVENTION

The present invention provides a device for sharpening broadheads which overcomes all the above mentioned disadvantages of the previously known devices.

In brief, the broadhead sharpener of the present invention comprises a base having a first and second planar hone. Both the first and second planar hones are pivotally mounted to the base so that the pivotal axis of the hones are spaced apart and generally parallel to each other. Consequently, the hones are positioned laterally adjacent each other and the angle of intersection or inclination between the hones can be varied by pivoting the hones about their axes.

In the preferred form of the invention, each pivotal mounting means for the hones includes a plurality of predetermined angular index stops. These index stops allow the hones to be pivoted to preset angular positions, designed to accommodate a particular broadhead style, and then lock the hones in their adjusted pivotal position.

In the preferred embodiment of the invention, the base is constructed from two parts wherein one hone is pivotally mounted to each base part. The base parts, furthermore, are laterally slidably secured together so that the lateral distance in between the hones can be varied as required in order to accommodate different types of broadheads.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is an exploded view illustrating a preferred embodiment of the invention;

FIG. 2 is a crossectional view taken substantially along line 2—2 in FIG. 1;

FIG. 3 is a crossectional view taken substantially along line 3—3 in FIG. 2; and FIGS. 4A, 4B and 4C are all diagrammatic views illustrating the operation of the preferred embodiment of the present invention.

DETAILED DESCRIPTION OF A PREFERRED EMBODIMENT OF THE PRESENT INVENTION

With reference first to FIGS. 1 and 2, a preferred embodiment of the broadhead sharpener 10 of the present invention is thereshown and comprises a base 12 having a first part 14 and a second part 16. The base part 14 includes a top surface 18, a bottom surface 20 and sides 22. Similarly, the base part 16 includes a bottom surface 24, a top surface 26 and sides 28.

Still referring to FIGS. 1 and 2, a pair of elongated tongues 30 extend perpendicularly outwardly from one side 28 of the base part 16. These tongues 30 are slidably received within receiving slots 32 formed between the sides 22 of the other base part 14.

The tongues 30, together with the slots 32 thus allow the lateral spacing between the base parts 14 and 16 to be varied for a reason to be subsequently described. Furthermore, once the lateral spacing between the base parts 14 and 16 is set by the user to the desired amount, two set screws 34 are threadably mounted to the base part 14 and the screws 34 abut against the tongues 30, when tightened, and lock the base parts 14 and 16 together against lateral movement.

With reference now particularly to FIGS. 1 and 3, an inverted V-shaped pivot support 40 extends upwardly from the upper surface 18 of the base part 14 adjacent each of its ends. Consequently, as best shown in FIG. 3, the pivot supports 40 are spaced apart and parallel to each other.

Similarly, a pair of inverted V-shaped pivot supports 42 are mounted to the other base part 16 so that one pivot support 42 is adjacent each end of the base part 16. The pivot supports 42 are spaced apart and parallel to each other.

Still referring to FIGS. 1 and 3, a first generally planar hone support member 44 is pivotally mounted in between the pivot supports 40 by pivot pins 46. In addition, a generally planar hone 48 is secured to an upper surface 50 of the support member 44 in any conventional fashion, such as by an adhesive.

Similarly, as shown in FIG. 1, a second generally planar hone support member 52 is pivotally mounted in between the pivot supports 42 by pivot pins 54. A second hone 56 is then secured to an upper surface 58 of the support member 52 in any conventional fashion, such as an adhesive.

As best shown in FIG. 2, with the support members 44 and 52 pivotally mounted to the base parts 14 and 16, respectively, the pivotal axis of the support members 44 and 52 are spaced apart and parallel to each other. Furthermore, the pivot pins 46 and 54 allow the support members 44 and 52, together with their attached hones 48 and 56 to pivot as shown in phantom line.

Referring now particularly to FIG. 2, each support member 44 and 52 includes an indexing ring 60 and 62, respectively, which is preferably constructed of a resilient or deformable material, such as plastic. The indexing rings 60 and 62 each include indexing stops 64 which cooperate with an indexing tab 66 on the base 12 in order to lock the support members 44 and 52 at preset adjusted angular positions with respect to each other. As will become shortly apparent, these preset angular positions correspond to the desired angular orientation between the hones 48 and 54 for different styles of broadheads.

With reference now to FIG. 4A, in order to sharpen a particular style of broadhead 70, the support members 44 and 52 are pivoted until the indexing stop 64 registers with the indexing tab 66 for the particular style of broadhead 70. In doing so, the angular orientation of the hones 48 and 56 is preset by the indexing rings 60 and 62 to accommodate the particular style of broadhead 70.

With reference now to FIG. 4B, a different type of broadhead 70′ is thereshown. In order to sharpen this broadhead 70′, the support members 44 and 52, are pivoted to a different angular position than shown in FIG. 4A. In doing so, the angular orientation of the hones 48 and 56 are preset to the mount which is designed to accommodate the broadhead 70′.

Similarly, with respect to FIG. 4C, the support members 44 and 52, together with their attached hones 48 and 56 are pivoted to still a different position with respect to each other thus again changing the angular orientation of the hones 48 and 56 with respect to each other. This angular orientation shown in FIG. 4C is designed to accommodate a still different style of broadhead 70″.

Furthermore, with respect to FIGS. 4A, 4B and 4C, the lateral spacing between the base parts 14 and 16 is adjusted as required in order to accommodate the particular broadhead styles 70, 70′ or 70″. As previously described, the tongues 30 allow the base parts 14 and 16 to move along a path of travel with respect to each other which is perpendicular to the pivotal axes of the hones 48 and 56 but parallel to a plane extending between the pivotal axes of the hones 48 and 56.

From the foregoing, it can be seen that the present invention provides a device for sharpening broadheads of any of a plurality of different types of styles.

Having described my invention, however, many modifications thereto will become apparent to those skilled in the art to which it pertains without deviation from the spirit of the invention as defined by the scope of the appended claims.

I claim:

1. A device of sharpening broadheads comprising
a base,
a first hone,
a second hone,
means for pivotally mounting said first hone to said base about a first axis,
means for pivotally mounting said second hone to said base about a second axis,
wherein said first and second axes are spaced apart and parallel to each other
wherein each of said pivotal mounting means comprises detent means for releasably locking each of said hones at at least two predetermined angular positions of said hones with respect to said base.

2. The invention as defined in claim 1 wherein each said locking means comprises a deformable indexing ring attached to said hone which pivots in unison with said hone, said ring having a plurality of spaced notches which selectively register with a tab on said base in dependence upon the pivotal position of said hone.

3. The invention as defined in claim 1 wherein said base comprises a first part and a second part, said first home being pivotally moounted to said first part and said second hone being pivotally mounted to said second part, and means for slidably mounting said base parts together along a path of travel perpendicular to the pivotal axes of said hones and parallel to a plane extending between said pivotal axes.

4. The invention as defined in claim 3 and comprising means for locking said base parts together at an adjusted position along said path of travel.

5. The invention as defined in claim 3 wherein said slidable mounting means comprises at least one elongated tongue extending outwardly from one base part, said tongue being slidably received in a slot on the other base part.

* * * * *